United States Patent [19]

Mackniesh

[11] 4,133,467

[45] Jan. 9, 1979

[54] GOLF CLUB CARRIER

[75] Inventor: Frank Mackniesh, Huntington Woods, Mich.

[73] Assignee: FPD Corporation, Huntington Woods, Mich.

[21] Appl. No.: 847,333

[22] Filed: Oct. 31, 1977

[51] Int. Cl.[2] ..... B65D 71/00

[52] U.S. Cl. ..... 224/52; 211/60 G

[58] Field of Search ..... 224/52, 55, 58, 49, 224/46 R, 45 S, 45 J, 5 E, 28 A; 211/60 R, 60 S, 60 G; 248/305, 306, 316 R, 163; 24/3 R, 16 R, 19, 270, 271; 294/31.2, 82 R

[56] References Cited

U.S. PATENT DOCUMENTS

| | | | |
|---|---|---|---|
| 1,719,360 | 7/1929 | Deike | 211/60 G |
| 2,752,974 | 7/1956 | Runner | 224/49 |
| 2,982,455 | 5/1961 | Rosen | 224/46 R |
| 2,987,109 | 6/1961 | Sohmer | 150/1.5 R |
| 3,232,503 | 2/1966 | Thonen | 211/60 G |
| 3,575,458 | 4/1971 | Grook, Jr. et al. | 294/82 R |

*Primary Examiner*—Trygve M. Blix
*Assistant Examiner*—Kenneth W. Noland
*Attorney, Agent, or Firm*—Reising, Ethington, Barnard, Perry & Brooks

[57] ABSTRACT

A golf club carrier including at least one club holder which receives the shafts of clubs to be carried by sideways movement thereinto for retention and clamping during carrying and for selective release of the clamping to permit axial endways withdrawal of the club shafts for use. Two of the club holders are preferably utilized mounted on a frame in spaced relationship to each other. Each of the club holders includes a bracket and a flexible strap with one end connected to the bracket so as to form a loop for receiving the club shafts. A handle is connected to the other ends of the straps so as to tension the strap loops and thereby clamp the club shafts during carrying. A movable retainer mounted on each bracket allows the sideways club shaft movement into the strap loop of the holder and prevents sideways movement of the club shafts out of the holders. The bracket of each holder includes a lower hook portion that receives the strap loop and an upper shank portion that extends upwardly from the hook portion. Each retainer is pivotally connected to the hook portion of the associated bracket and spring biased to a position providing closing thereof while being movable to an open position to allow the sideways club shaft movement into the holders.

10 Claims, 3 Drawing Figures

GOLF CLUB CARRIER

SUMMARY OF THE INVENTION

An object of the present invention is to provide an improved lightweight golf club carrier in which club shafts are received by one or more club holders by a sideways movement and retained thereto by a strap clamping action as well as being selectively released for axial endways removal.

In carrying out the above object, the club carrier includes a frame which preferably has two spaced club holders that retain the club shafts. Each club holder includes a bracket and a flexible strap connected to the bracket so as to form a loop for receiving the club shafts. Movable retainers on the brackets allow the sideways club shaft movement into the strap loops and retain the club shafts within the loops. A handle is connected to the straps to tension the loops thereof so as to clamp the club shafts during carrying of the clubs.

Each holder bracket includes a lower hook portion that receives the strap loop and an upper shank portion extending upwardly from the hook portion. Pivotal connections mount the retainers on the hook portions of the associated brackets and springs thereof bias the retainers to closed positions that close the bracket hook portions and thereby retain the club shafts within the strap loops. Movement of the retainers against the spring bias thereof allows the club shafts to be received by a sideways movement into the strap loops. Apertures in the hook portions and the upper shank portions of the brackets receive the strap ends that extend upwardly for connection to the handle.

An upper frame member connects the shank portions of the two club holder brackets and is movable upwardly and downwardly by the golfer's fingertips with his hand grasping the handle so as to tension and untension the strap loops and thereby control clamping and release of the club shafts. Each bracket also includes an inverted U-shaped leg member having downwardly extending legs for standing the carrier on the ground. A pair of lower frame members connect the legs of the holder brackets to provide a rigid interconnection between the brackets and a durable carrier construction.

The objects, features, and advantages of the present invention are readily apparent from the following detailed description of the preferred embodiment taken in connection with the accompanying drawings.

DETAILED DESCRIPTION OF THE PREFERRED EMBODIMENT

Figure 1:
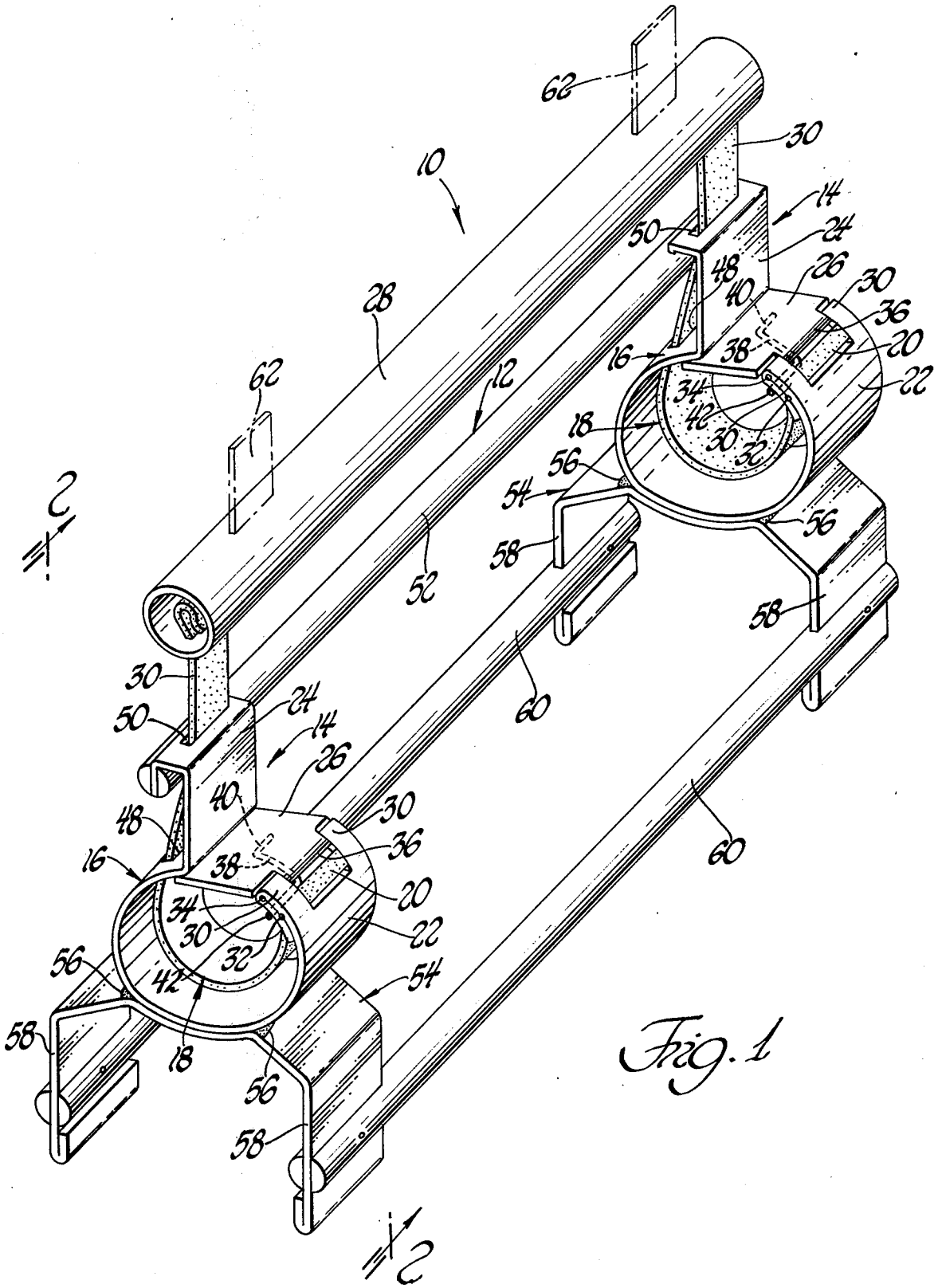
FIG. 1 is a perspective view of a golf club carrier constructed according to the present invention.

Referring to FIG. 1, a lightweight golf club carrier constructed according to the present invention is indicated generally by reference numeral 10 and includes a frame 12 having a pair of club holders 14 that are spaced from each other. Each club holder 14 includes a bracket 16 and a flexible strap 18 with one end 20 connected to a bracket hook portion 22 from which a bracket shank portion 24 extends upwardly. Each strap 18 has an intermediate portion that forms a loop within the associated bracket hook portion 22. Movable retainers 26 of the club holders are mounted on the bracket hook portions 22 adjacent the strap ends 20, in a manner which is more fully hereinafter described, and allow sideways club shaft movement into the strap loops within the bracket hook portions while preventing reverse movement of the club shafts sideways out of the holders. A handle 28 is connected to strap ends 30 and is manually grasped so that the weight of the rest of the carrier hanging down tensions the strap loops within the bracket hook portions 22 to clamp the club shafts. Release of this tension unclamps the club shafts to allow endways removal of the club shafts in an axial direction for use of the clubs.

Figure 2:
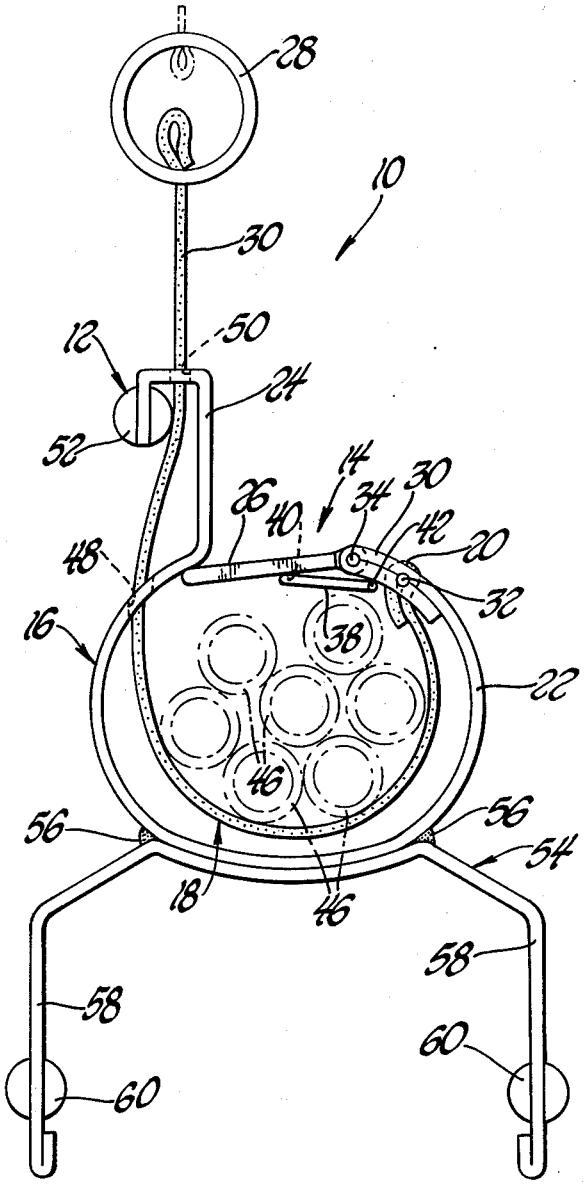
FIG. 2 is an end view of the carrier taken along line 2—2 of FIG. 1 and showing phantom line indicated golf club shafts retained thereby.
Figure 3:
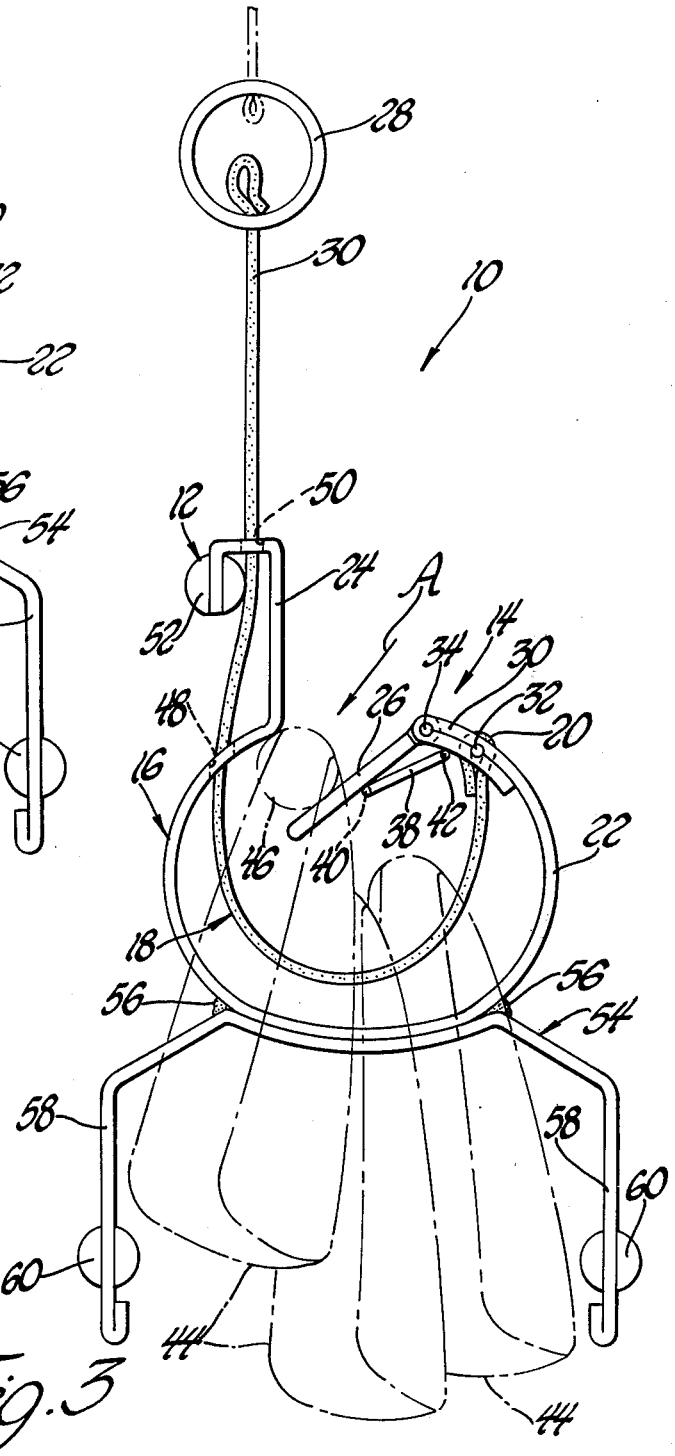
FIG. 3 is an end view similar to FIG. 2 but showing the manner in which a golf club shaft is inserted by a sideways movement for retention by the carrier.

As seen by combined reference to FIGS. 1 and 2, bracket hook portion 22 has a bifurcated shape adjacent the strap end 20 where it includes tines 30 each of which is formed to extend back on itself with the ends of pins 32 and 34 positioned therebetween. Pin 32 extends between the two tines 30 with the strap end 20 looped thereabout to provide strap securement to the bracket. Pin 34 extends through a retainer tab 36 to pivotally mount the retainer 26 on the bracket hook portion 22. A somewhat Z-shaped spring 38 of each holder has one leg 40 fixedly secured in a suitable manner to the inner side of the retainer 26 and another leg 42 slidably engaged with the inner side of one of the bracket tines 30. As one of the clubs 44 shown in FIG. 3 is moved sideways along the direction of arrow A so that its shaft 46 pushes down on the retainer 26, the spring leg 42 slides along the tine 30 and tends to increase the angle between the spring 38 and the retainer. This angular increase is resisted in a resilient manner by the bias of spring 38 so that the retainer 26 is automatically moved back from its open position of FIG. 3 to its closed position of FIG. 2 once the club shaft insertion is completed. Consequently, the retainer 26 then closes the bracket hook portion 22 and thereby retains the club shaft 46 within the loop formed by the strap 18. Each strap 18 extends upwardly through an aperture 48 in the bracket hook portion 22 and an aperture 50 in the bracket shank portion 24. As the carrier 10 is picked up by the handle 28, the straps 18 slide through these apertures 48 and 50 under the weight of the carrier such that the straps 18 clamp the club shafts 46 to prevent axial movement thereof through the holders.

As best seen in FIG. 1, the frame 12 includes an upper frame member 52 with opposite ends that are secured in a suitable manner to the upper end of the bracket shank portions 24. Each bracket 16 also includes a leg member 54 of an inverted U shape secured to the bracket hook portion 22 by welds 56. Legs 58 of each bracket leg member 54 extend downwardly and are connected with the legs of the other bracket leg member by a pair of lower frame members 60. During use, the golfer can sit the carrier 10 down on the ground with the legs 58 supporting the clubs out of engagement with the ground. Clamping and unclamping of the club shafts within the loops formed by the straps 18 is achieved by manually grasping the handle 28 and moving the upper frame member 52 by finger action upwardly for unclamping and releasing it for downward movement to provide the clamping.

It should be understood that many variations of the carrier herein disclosed are possible. For example, a shoulder strap 62 as shown by phantom lines in FIG. 1 can be attached to the handle 28 in a suitable manner so that the carrier 10 can be carried over the golfer's shoulder. Various materials and processes may be utilized to construct the carrier components such as either plastic molding of the brackets 16 or extruding the brackets from aluminum, etc. Likewise, the handle 28, the retainers 26, and the frame members 52 and 60 can also be made from different materials. Straps 18 can be made from cloth or from any other flexible material with an elongated shape that will provide the clamping action described. All of these variations are familiar to those skilled in the art and are within the scope of the claims which follow.

What is claimed is:

1. a golf club carrier comprising: a frame including at least one club holder having a bracket which has a lower hook portion; a flexible strap forming a loop within the bracket hook portion for receiving golf club shafts to provide club carrying; the club holder also having a retainer mounted for movement on the bracket hook portion between open and closed postions with respect thereto; the retainer allowing the club shafts to be positioned and retained within the strap loop upon a sideways movement thereinto; means biasing the retainer to the closed position thereof on the bracket hook portion; the club shafts being pulled endways for removal of the clubs from the holder; and a handle connected to the strap so that the strap loop can be tensioned and thereby clamp the club shafts during carrying of the clubs by the carrier.

2. A golf club carrier comprising: a frame including a pair of spaced club holders; each holder having a bracket including a lower hook portion; each holder including a flexible strap with opposite ends one of which is connected to the associated bracket; said straps each having an intermediate strip portion forming a loop located within the associated bracket hook portion to receive golf club shafts in order to provide club carrying; each club holder also having a retainer mounted for movement on the associated bracket hook portion between open and closed positions with respect thereto; the retainers allowing the club shafts to be positioned and retained within the strap loops upon a sideways movement thereinto; springs for biasing the retainers to the closed positions on the associated bracket hook portions; the club shafts being pulled endways for removal of the clubs from the holders; and a handle connected to the other ends of the straps so that the strap loops can be tensioned and thereby clamp the club shafts during carrying of the clubs by the carrier.

3. A golf club carrier comprising: a frame including a pair of spaced club holders; each holder having a bracket and a flexible strap with opposite ends one of which is connected to the associated bracket; said straps each having an intermediate strap portion forming a loop for receiving golf club shafts to provide club carrying; each bracket including a lower hook portion and an upper shank portion extending upwardly from the hook portion; the strap loop of each holder being received within the bracket hook portion thereof; each club holder also having a movable retainer on the associated bracket for allowing the club shafts to be positioned and retained within the strap loops upon a sideways movement thereinto; each retainer having a pivotal connection to the hook portion of the associated bracket; springs that bias the retainers to closed positions that retain the club shafts within the strap loops in the bracket hook portions while being movable to open positions against the bias of the springs to receive the club shafts; the club shafts being pulled endways for removal of the clubs from the holders; and a handle connected to the other ends of the straps so that the strap loops can be tensioned and thereby clamp the club shafts during carrying of the clubs by the carrier.

4. A carrier as in claim 3 further including an upper frame member that connects the upper shank portions of the brackets and can be grasped to unclamp the club shafts from the strap loops.

5. A carrier as in claim 3 wherein each hook portion and each shank portion of both brackets have apertures through which the associated straps extend for connection to the handle.

6. A carrier as in claim 3 further including legs on the brackets for standing the carrier on the ground.

7. A carrier as in claim 3 wherein each bracket includes an inverted U-shaped leg member having downwardly extending legs for standing the carrier on the ground and a pair of lower frame members connecting the legs of the spaced brackets.

8. A golf club carrier comprising: a frame including a pair of spaced club holders; each club holder having a bracket with a lower hook portion and an upper shank portion extending upwardly from the hook portion; a flexible strap for each holder; each strap having opposite ends one of which is connected to the hook portion of the associated bracket and also having an intermediate strap portion forming a loop within the bracket hook portion for receiving golf club shafts to provide club carrying; a retainer for each holder mounted on the bracket hook portion thereof for movement to an open position to receive the club shafts within the strap loops in the bracket hook portions and biased to a closed position to retain the club shafts within the strap loops; and a handle connected to the straps so that the strap loops can be tensioned and thereby clamp the club shafts during carrying of the clubs by the carrier.

9. A carrier as in claim 8 further including legs that extend downwardly from the bracket hook portions to stand the carrier on the ground.

10. A carrier as in claim 9 further including an upper frame member that connects the upper shank portions of the brackets and which can be grasped to unclamp the club shafts from the strap loops.

* * * * *

UNITED STATES PATENT AND TRADEMARK OFFICE

CERTIFICATE OF CORRECTION

PATENT NO. : 4,133,467

DATED : January 9, 1979

INVENTOR(S) : Frank Mackniesh

It is certified that error appears in the above-identified patent and that said Letters Patent are hereby corrected as shown below:

Column 1, after "GOLF CLUB CARRIER" and before "SUMMARY OF THE INVENTION" insert

--BACKGROUND OF THE INVENTION

Field of the Invention

This invention relates to an improved lightweight golf club carrier.

Description of the Prior Art

Lightweight golf club carriers are specifically designed for golfers who prefer to golf with two woods, several irons, and a putter as opposed to the more professional type golfers who use twelve to fourteen clubs and thus require a relatively heavy bag for carrying their clubs. In addition to being relatively lightweight, these carriers do not take up a great deal of space like the larger golf bags and thus can be transported relatively easily during trips on which cargo space may be at a premium.

United States patents 2,465,096; 2,737,990; and 3,215,181 disclose one type of golf club carrier in which a frame has resilient clips for securing club shafts in order to carry the clubs. Each club shaft is moved in a sideways direction upon being secured by clips and during removal from the clips for

UNITED STATES PATENT AND TRADEMARK OFFICE

CERTIFICATE OF CORRECTION

PATENT NO. : 4,133,467

DATED : January 9, 1979

INVENTOR(S) : Frank Mackniesh

It is certified that error appears in the above-identified patent and that said Letters Patent are hereby corrected as shown below:

use of the club. The clips must be mounted in a spaced relationship to each other so that the clubs are arranged like the rungs of a ladder upon being secured. More space is thus required for this type of carrier than is the case with the club shafts located adjacent each other like a bundle of sticks.

United States patents 2,486,827; 2,752,974; and 2,791,255 disclose lightweight golf club carriers wherein each club is received by and removed from the carrier by an axial club shaft movement. While the storage space of this type of carrier is much less than the other type of carrier described above, the axial insertion required to receive the clubs by the carrier can be a somewhat cumbersome movement.--

Signed and Sealed this

Tenth Day of July 1979

[SEAL]

Attest:

Attesting Officer

LUTRELLE F. PARKER

Acting Commissioner of Patents and Trademarks